US006237360B1

(12) United States Patent
Corona

(10) Patent No.: US 6,237,360 B1
(45) **Date of Patent: *May 29, 2001**

(54) CHILLING AND/OR STORING RECEPTACLE FOR BOTTLES OR BEVERAGE CONTAINERS

(76) Inventor: Gary L. Corona, 7027 Hunters Glen, Dallas, TX (US) 75205

( * ) Notice: Subject to any disclaimer, the term of this patent is extended or adjusted under 35 U.S.C. 154(b) by 0 days.

This patent is subject to a terminal disclaimer.

(21) Appl. No.: 09/435,572

(22) Filed: Nov. 8, 1999

Related U.S. Application Data

(63) Continuation-in-part of application No. 09/112,370, filed on Jul. 9, 1998, now Pat. No. 6,050,104.

(51) Int. Cl.[7] ..... F25D 3/08

(52) U.S. Cl. ..... 62/457.4; 62/457.8; 62/459; 62/463

(58) Field of Search ..... 62/457.8, 457.4, 62/459, 463

(56) References Cited

U.S. PATENT DOCUMENTS 5,444,992 * 8/1995 Bell ..... 62/372
5,983,662 * 4/2000 Luetsch ..... 62/457.4
6,050,104 * 4/2000 Corona ..... 62/457.4

* cited by examiner

*Primary Examiner*—William Doerrler
*Assistant Examiner*—Mark S. Shulman
(74) *Attorney, Agent, or Firm*—Jackson Walker LLP

(57) ABSTRACT

A beverage cooling apparatus including a cylinder shaped receptacle extending into a second receptacle for receiving ice, the cylindrical receptacle having one open end to receive bottles or beverage containers. The apparatus can be utilized in an ice bin, ice chest, ice maker, freezer, or any refrigerated placement area to chill, refrigerate or store open, partially used or unused bottles, such as wine or liquor, or any other beverage container that is best when served cold or should be preserved cold.

The receptacle is provided in a slanted position, and contains slots or openings small enough to prevent ice cubes or ice chunks from entering the chilling or storing area.

20 Claims, 6 Drawing Sheets

FIG. 1
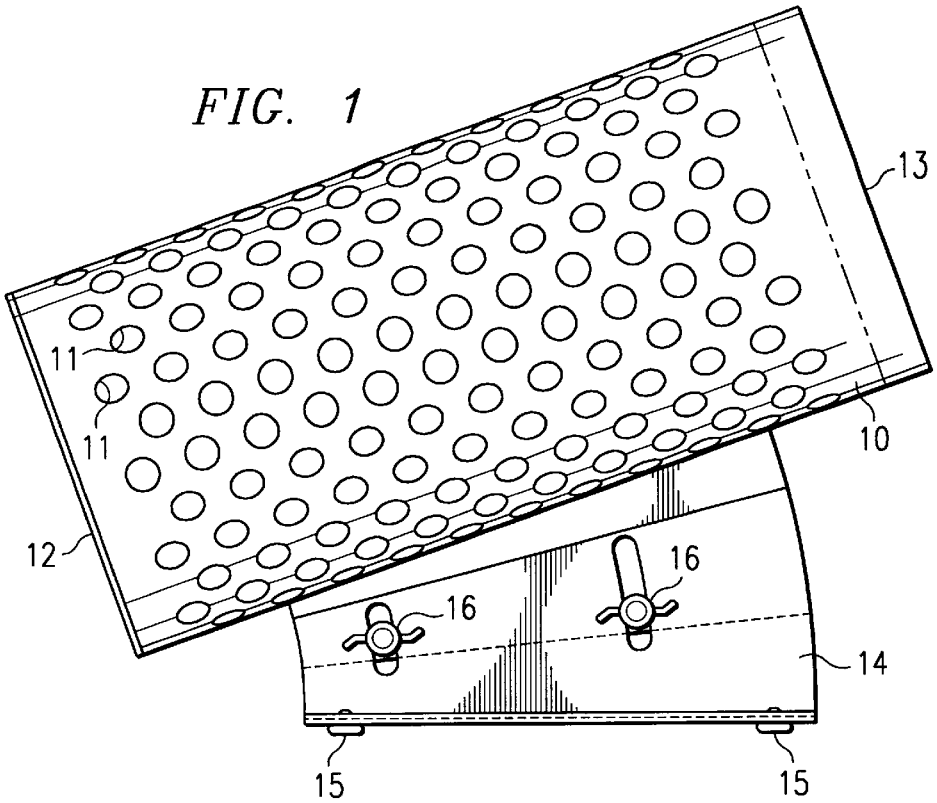
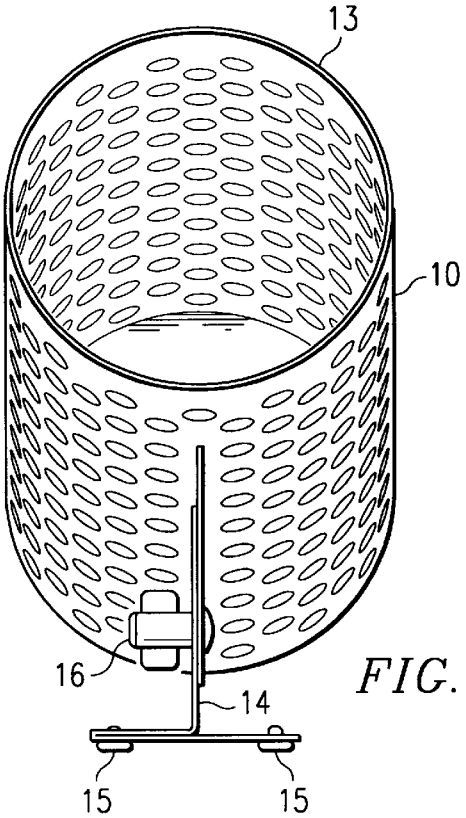
FIG. 2
FIG. 3
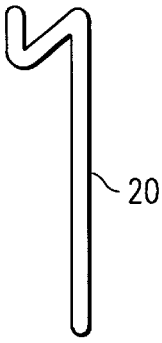

FIG. 4
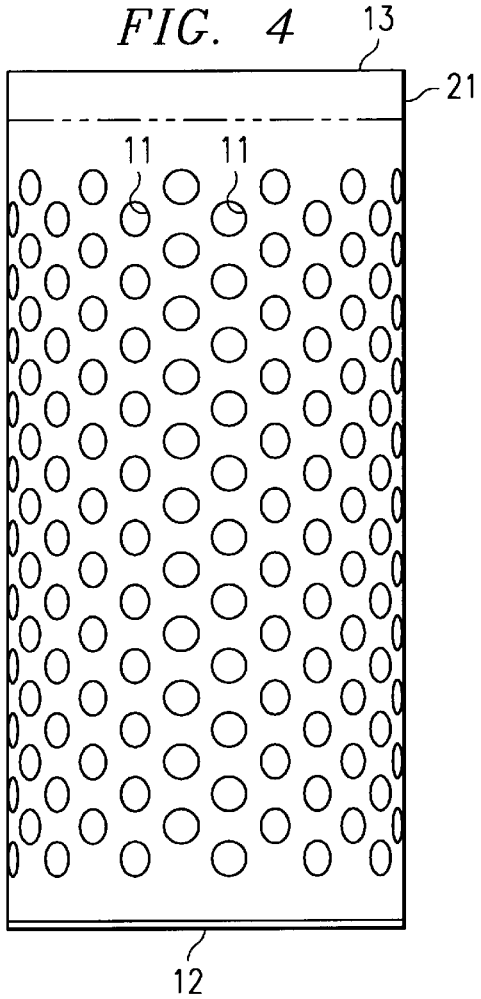
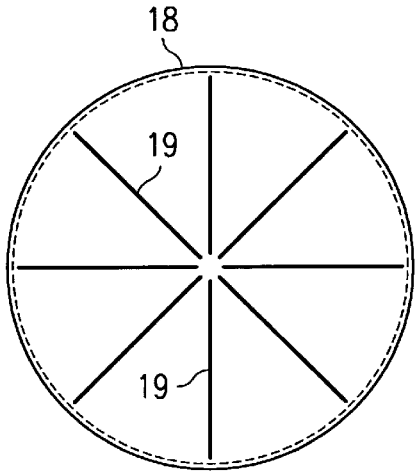
FIG. 6
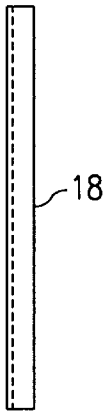
FIG. 6A
FIG. 5
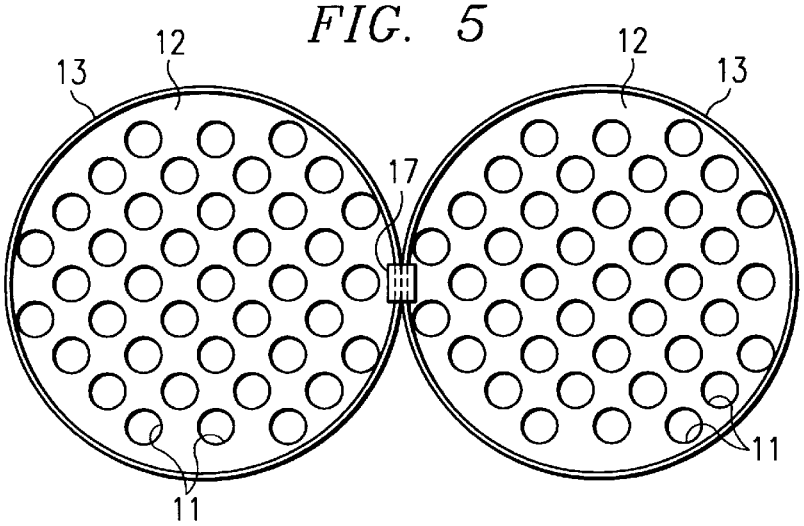
FIG. 5A
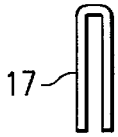

CHILLING AND/OR STORING RECEPTACLE FOR BOTTLES OR BEVERAGE CONTAINERS

CROSS REFERENCE TO RELATED APPLICATION

This application is a continuation-in-part of, is related to, and claims priority from, parent U.S. patent application Ser. No. 09/112,370 by Corona entitled "Chilling and/or Storing Receptacle for Bottles or Beverage Containers" filed on Jul. 9, 1998 now U.S. Pat. No. 6,050,104 which is incorporated herein by reference in its entirety.

FIELD OF THE INVENTION

The present invention is generally related to beverage cooling apparatuses, and more particularly to a device for cooling wine bottles and other beverage containers.

BACKGROUND OF THE INVENTION

This invention provides a means of efficiently, sanitarily and conveniently chilling, refrigerating or storing bottles or beverage containers that are best when stored or served cold. The conventional placement method to either chill, refrigerate or store bottles or beverage containers is to place the bottle or beverage container itself, directly in the refrigerator or an ice maker or ice bin.

The method of placing a bottle or beverage container in a residential ice maker or commercial ice bin is usually complicated due to the fact that the bottle or beverage container becomes slippery when wet and the bottle or beverage container labels typically fall off or begin to disintegrate into the ice bin area when left for any length of time, no matter how brief. When the labels come off in a residential ice maker bin or commercial ice bin, the end result is that particles of the label sink to the bottom of the bin and clog the ice maker or ice bin drainage line, thus resulting in a water removal problem since the water from melting ice stays in the ice bin and ultimately overflows onto the floor or some other area. A plumber must then be called to unclog the drainage line and any damage to the floor or cabinet area must be repaired.

Another problem is that the bottles or beverage containers typically sink to the bottom of the ice bins and must then be located and retrieved in the sanitized ice either by someone's hand or by some other instrument. When placing bottles or beverage containers in an ice bin for commercial purposes, such as a bar or restaurant situation, the bottles or beverage containers are placed in the ice bin that also provides ice for the drinks by its patrons. This situation provides the opportunity for a bottle or beverage container to get broken in the ice bin when another bottle or beverage container is slammed into the ice after a drink has been poured.

It also provides an extremely unsanitary situation by contaminating the sanitized ice since these bottles or beverage containers are handled by numerous people, are not cleaned off every time they are removed from the ice before being placed back into the ice bin and are typically stored in the same ice bin that provides the ice utilized for patrons drinks. The commercial ice bin in which the bottles and beverage containers are placed or stored is rarely separated from the ice used in the patron glasses.

When most bottles are placed in a residential refrigeration unit after opening, such as wine, the bottle is usually too tall to stand upright in the refrigerator once the cork has been replaced in the bottle after opening. The bottle is usually laid on its side in the refrigerator, resulting in the bottle dripping liquid on the shelves of the refrigerator due to a poor seal from the cork being reinserted into the open bottle.

This cylindrical receptacle provides a convenient, sanitary, organized, effective method, whether for residential or commercial use, for the complete or partial storage or placement of a beverage container(s) or bottle(s) that is best when served cold or chilled.

It is an objective of the invention to provide a sanitary and effective means to place or store beverage containers and bottles in ice makers, ice bins, ice chests, or in refrigerated units.

It is also an objective of the invention to provide a receptacle that will cool or chill beverage containers or bottles in an organized fashion while aiding in the elimination of breakage or spilled liquids.

It is another objective of the invention to provide an inexpensive chilling or storing receptacle to be utilized in an ice bin for beverage containers or bottles.

The present invention achieves technical advantages as a convenient beverage cooling device adapted to be placed in a cooling chamber, such as a freezer, or even integrally forced into the cooling chamber to cool a beverage container without allowing the beverage container to get wet.

BRIEF DESCRIPTION OF THE DRAWINGS

FIG. 1 is a perspective side-view of the chilling and/or storing receptacle for bottles or beverage containers in a slanted position;

FIG. 2 is a perspective view of the receptacle illustrating the minimum and maximum adjustable positions;

FIG. 3 is a perspective view of the suspension clip;

FIG. 4 is a perspective view of the receptacle in a vertical position without the permanent support stand;

FIG. 5 is a perspective view of the receptacle connector clamp and a top view of two receptacles clamped together;

FIG. 6 is a perspective view of the specially designed rubber receptacle lid or cap;

DETAILED DESCRIPTION OF THE PREFERRED EMBODIMENT

Figure 7:
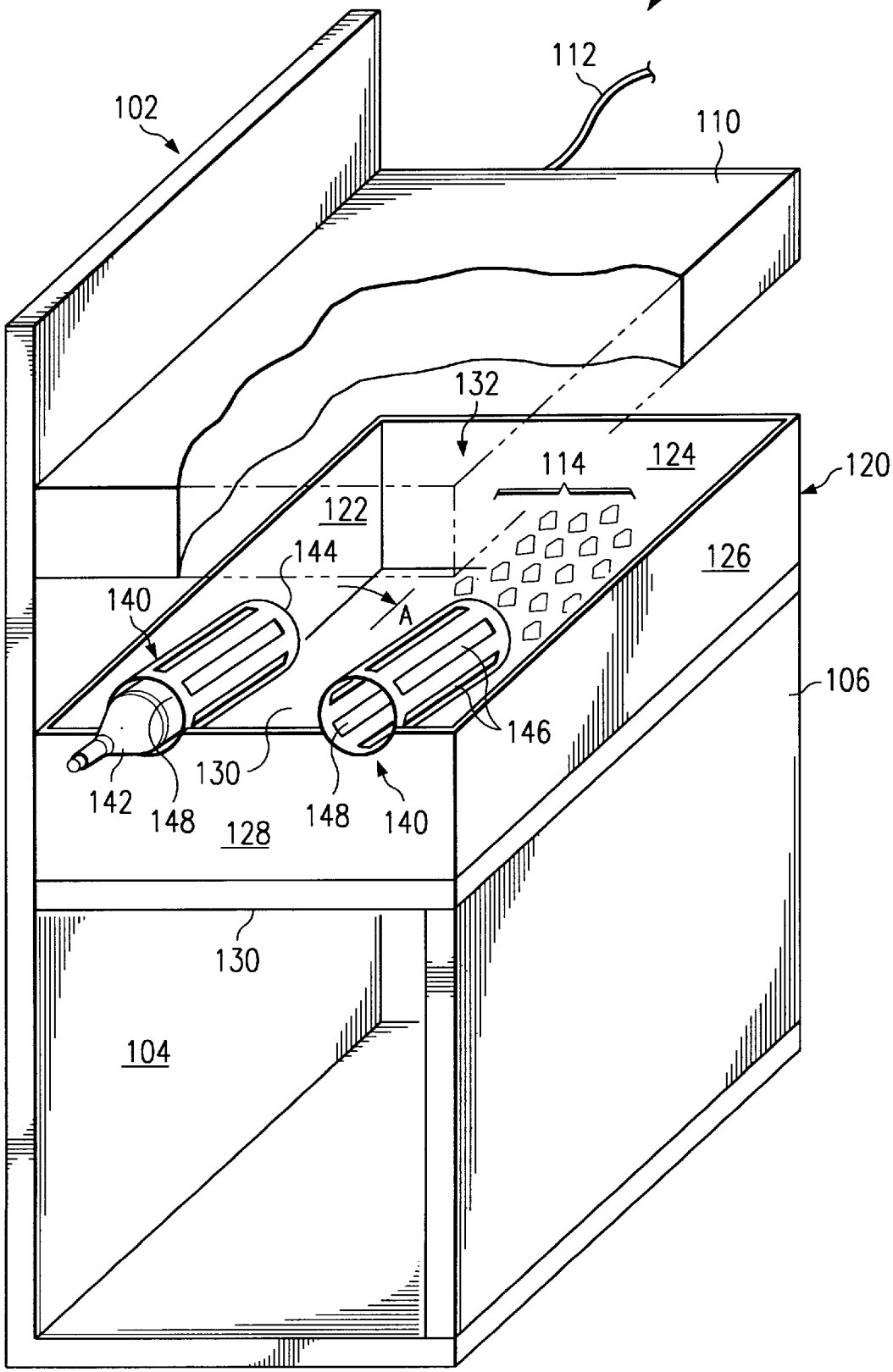
FIG. 7 is a perspective view of a second embodiment of the present invention comprising a unitary beverage container disposed in a cooling apparatus and adapted to generate and place ice in a non-contact arrangement about a beverage container.

The illustrations show a single and multiple bottle or beverage container receptacle according to a preferred design for this invention. Although the illustrated embodiment of the invention is designed for holding a 0.750–1.00 liter bottle or beverage container, the receptacle may be designed to hold other types and sizes of beverage containers and bottles by suitable alteration of the shape and dimensions of the receptacle.

The receptacle 10 is of cylindrical shape and is dimensioned to receive a typical bottle or beverage container such that the upper end of the bottle or beverage container projects out of the open end of the receptacle. Thus the diameter of the cylinder will be approximately equal to or slightly larger than the typical wine or liquor bottle and the length of the cylinder will be slightly less than that of the average wine or liquor bottle. It will be understood that the cylinder could easily be shaped and dimensioned to receive other types and sizes of bottles or beverage containers.

The cylindrical body of the receptacle is approximately 23.3 cm. in height with the diameter of the opening being approximately 11.11 cm. The receptacle is made of a solid material and is approximately 0.07 cm. thick. This material can vary from plastic to plated base metal to stainless steel. Other dimensions or materials may be provided or utilized to best accommodate the various products that can benefit from the purposes of this receptacle.

The cylindrical body of the receptacle has spaced longitudinal slots or openings 11 approximately 1.0 cm. in diameter around its periphery, which extend along the length and on the closed end 12 of the receptacle. Other shapes or openings may be provided or utilized to provide communication between the cylindrical receptacle and ice or the refrigeration unit. The slots or openings are small enough to prevent ice cubes from entering the receptacle. The rim 13 of the open end of the cylinder is rounded and smooth. When required, the pliably designed rubber receptacle lid or cap 18 approximately 11.18 cm. in diameter, approximately 0.15 cm. thick and has eight equally cut slits 19 with each slit approximately 6.45 cm. in length, easily snaps over the open end of the receptacle.

The adjustable, permanent support stand 14 that is approximately 7.6 cm. wide, has rubber footings 15 and is positioned by loosening two wing nuts 16 on the adjustable support stand. The stand will lock into place in varying positions depending on the point that the two wing nuts are retightened. The area of the cylinder opening closest to the surface supporting the receptacle is approximately 14.6 cm. from that surface when placed in the maximum slanted position.

The receptacles can be clustered together by utilizing a receptacle connector clamp 17 that is approximately 0.15 cm. thick, approximately 0.71 cm. wide and each side of the clamp is approximately 2.54 cm. in length. The connector clamp is pressed over the cylinder rim of two or more of the receptacles thus securing and stabilizing the multiple receptacles. When utilizing the receptacle without a support stand 21 in a commercial ice bin, the receptacle may be suspended in the ice bin by utilizing a receptacle suspension clip 20. This receptacle suspension clip is approximately 0.25 cm. thick. The short end of the clip, approximately 0.6 cm. in length, inserts into one of the openings along the top or open end of the receptacle, while the long end of the clip, approximately 5.0 cm. in length, hangs on the outside wall of the commercial ice bin. The width distance between the short end of the clip and the long end of the clip is approximately 1.27 cm.

While a first preferred embodiment of the invention has been described for purposes of illustrations, it will be understood that various changes and substitutions may be made by those skilled in the art without departing from the scope of the invention which is defined solely by the following claims.

Referring now to FIG. 7, there is shown a second embodiment to the present invention generally being shown at 100. A cooling body unit generally shown at 102 has a sealed cooling chamber 104. Cooled air having a temperature of 32° F. or below resides within chamber 104 and is generated by cooling unit 106 forming a portion of unit 100, but which could reside separately from unit 100 if desired. Also shown in FIG. 7 is an icemaker unit 110 receiving water from a waterline source 112 and generating ice 114.

A beverage cooling apparatus 120 is also disposed in chamber 104 as shown. Apparatus 120 may be integrally formed into the device 100, or maybe a separate unit disposed upon an integral shelf 122 of apparatus 100. Alternatively, the second receptacle could be selectively coupled to or removed from the ice bin or chest. Cooling apparatus 120 is adapted to receive and contain ice 114, such as generated and supplied by icemaker unit 110.

Ice cooling apparatus 120 has a plurality of side walls including walls 122, 124, 126, front wall 128, and a bottom member 130 together generally forming a first receptacle for holding ice 114 and generally shown at 132. Integrally formed within cooling apparatus 120 is a plurality of elongated receptacle cylindrical members 140 integrally formed in apparatus 120, and each preferably secured at one end to front wall 128. Each receptacle 140 is adapted to hold a beverage container, such as a bottle of wine generally shown at 142. Each second receptacle 140 further is defined to angle inwardly into first receptacle 132 and downwardly towards bottom member 130, angling at an angle generally being shown at A from a horizontal plane. Each second receptacle 140 preferably is elongated, is generally cylindrical, and is perforated substantially about the side walls thereof, and also across the end walls 144 by perforations 146. Because each second receptacle 140 is angled downwardly at the angle A, preferably at an angle of between 20 and 60° with respect to the horizontal plane and the top of apparatus 120, each beverage container, such as wine bottle 142, is angled downwardly into first receptacle 132 and is securely seated therewithin.

The present invention derives technical advantages whereby ice 114 is disposed within first receptacle 132, proximate second receptacle 140 and substantially about the elongated side walls of the second receptacles 140, and particularly about and a proximate the perforations 146. The ice 114 proximate the receptacles 140 communicate a chilled temperature to the beverage container 142 received within the particular receptacle 140, such as a bottle of wine 142, but which could comprise of other containers as well as such cans having a fluid therewithin for cooling. In addition, the cool air within chamber 104 further cools the container 142 disposed within the second receptacle 140.

The present invention also derives technical advantages whereby the containers 142 to be chilled are seated within the receptacles 140, but do not come into physical contact with any of the ice 114. Therefore, the containers are chilled, preferably at or below 32° F., but without coming into contact with the ice 114 or any water which may form in the bottom of first receptacle 132, and thus, the labels of the containers 142 do not become wet or wear off, nor does the container 142 become wet and slippery. Thus, the outer surface of the containers 142 remain dry yet chilled and can be easily gripped for removal and dispensing by a person.

There are several variations of the second embodiment of the present invention. First, the cooling apparatus 120 integrally formed all by itself. Second, an embodiment whereby the cooling apparatus 120 is in combination with the ice making unit 110 above there collectively dispensing ice into the first chamber 132 proximate and about the perforating second receptacles 146. A third embodiment is shown at 100 whereby the chilling apparatus 120 is disposed within the chamber 104, either Testing upon the shelf 122, or integrally formed into and connected with the side walls 102 of the apparatus. The ice-making unit 110 may be used in combination therewith as desired.

Another embodiment similar to that shown in FIG. 7 comprises cooling apparatus 120 being sufficiently large and holding a plurality of receptacles 146 and thus several containers, such as a large ice chest used in restaurants, taverns and the like whereby a plurality of wine bottles, liquors, or other spirits contained in bottles or other containers can be positioned within one of the plurality of forward facing receptacles 146, while other beverages, such as bottles of beer, soda, etc. can be directly immersed in the ice 114 contained within the chamber 132.

Figure 8:
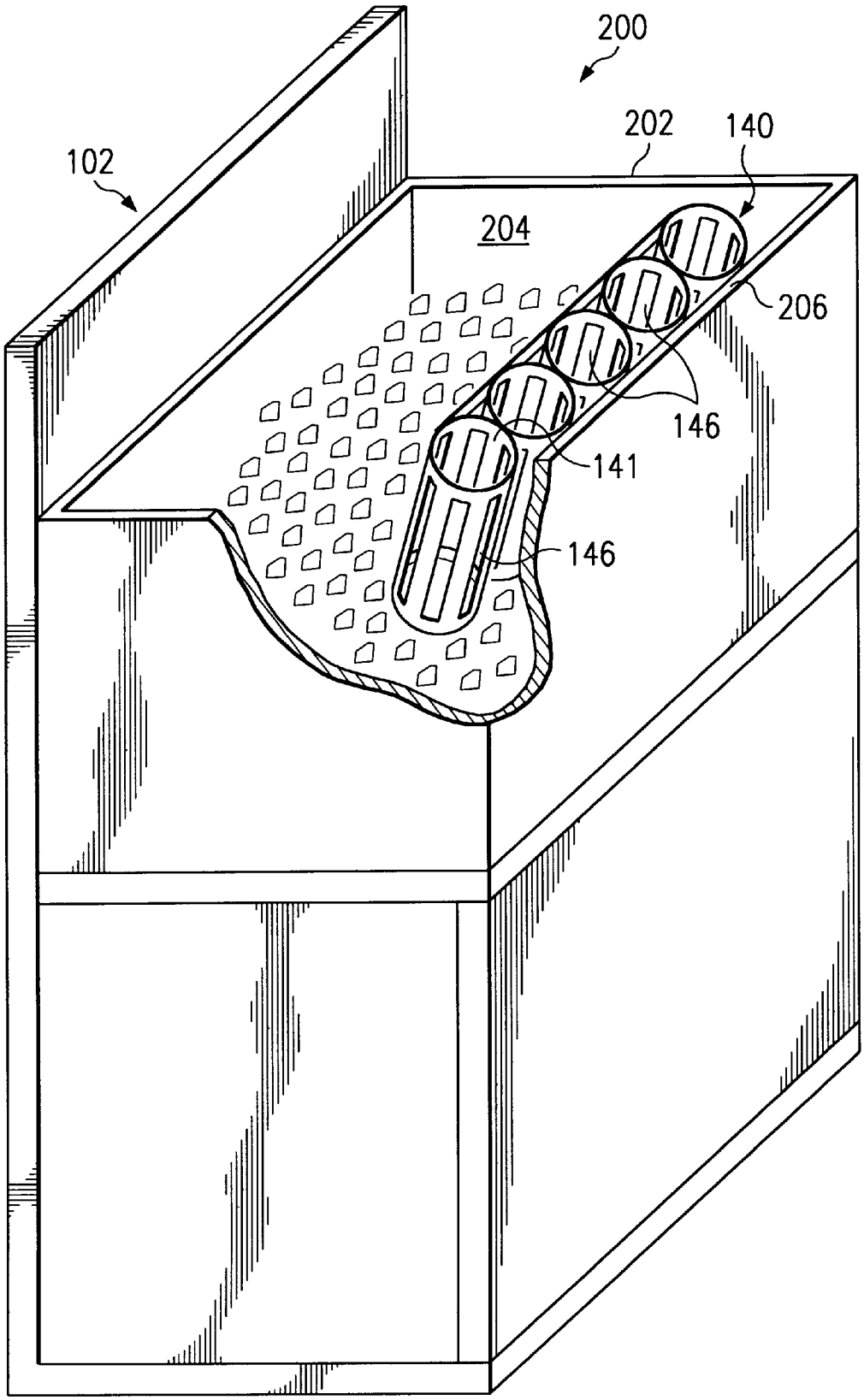
FIG. 8 is a perspective view of the second embodiment of the present invention configured as a commercial ice bin.

Referring now to FIG. 8, there is generally shown at 200 an alternative embodiment of the present invention configured as a commercial ice bin 202 having a first receptacle 204. A plurality of second receptacles 140, as previously discussed in regards to FIG. 7, are secured to the front edge 206 and extend downwardly at an angle into first receptacle 204 filled with ice. Openings 141 of each receptacle 146 face upwardly to provide easy access for disposing a beverage container thereinto and to provide sanitary conditions for the ice in the first receptacle 204 if utilized for patron glasses.

Figure 9:
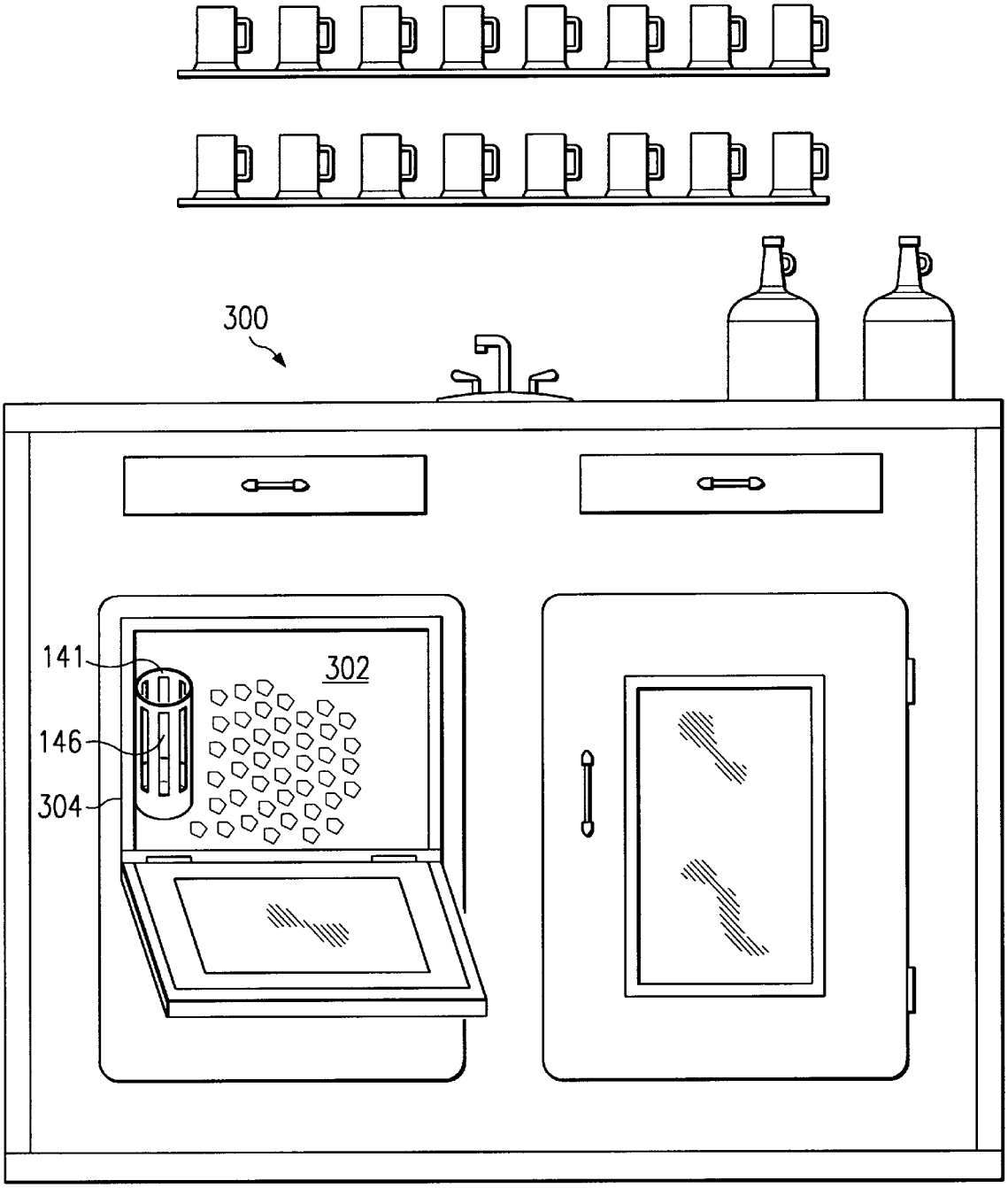
FIG. 9 is a front view of a residential wet bar having an ice maker or freezer component with the present invention molded into the interior side wall.

Referring now to FIG. 9, there is yet another embodiment of the present invention shown as a residential wet bar 300 having an ice maker or freezer compartment 302 and provided with an integrally secured beverage receptacle 146. Receptacle 146 is selectively secured to and selectively detachable from the side wall 304 of receptacle 302 via brackets or the like, and angles downwardly therein. The upper opening 141 is positioned towards the top of the receptacle 302 and is adapted to receive a receptacle angled downwardly into the ice and into the first receptacle 302.

Thus, the second embodiment of present invention has several variations each of which has the advantage of providing an integral second receptacle 140 extending into a first receptacle 132 for chilling a separate container, such as a bottle of wine 142, without bringing the container 142 into contact with the ice 114 yet being chilled thereby.

Figure 10:
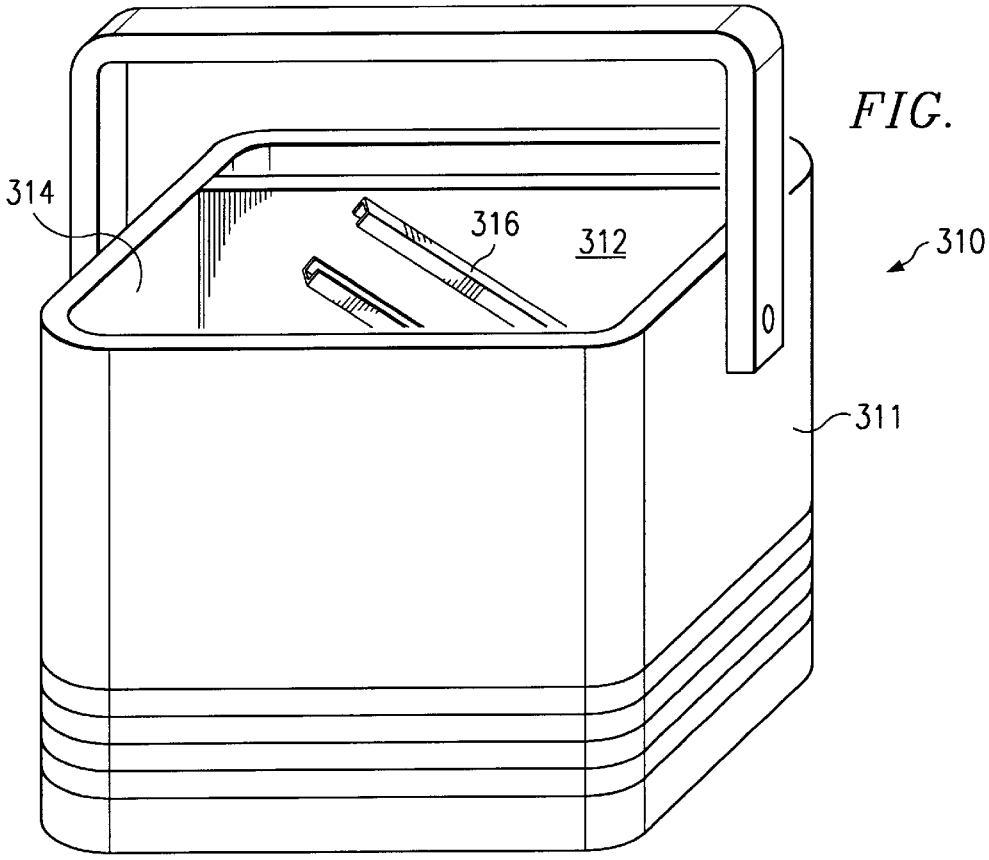
FIG. 10 is a perspective view of a wine case holder having an angled beverage container therein.
Figure 11:
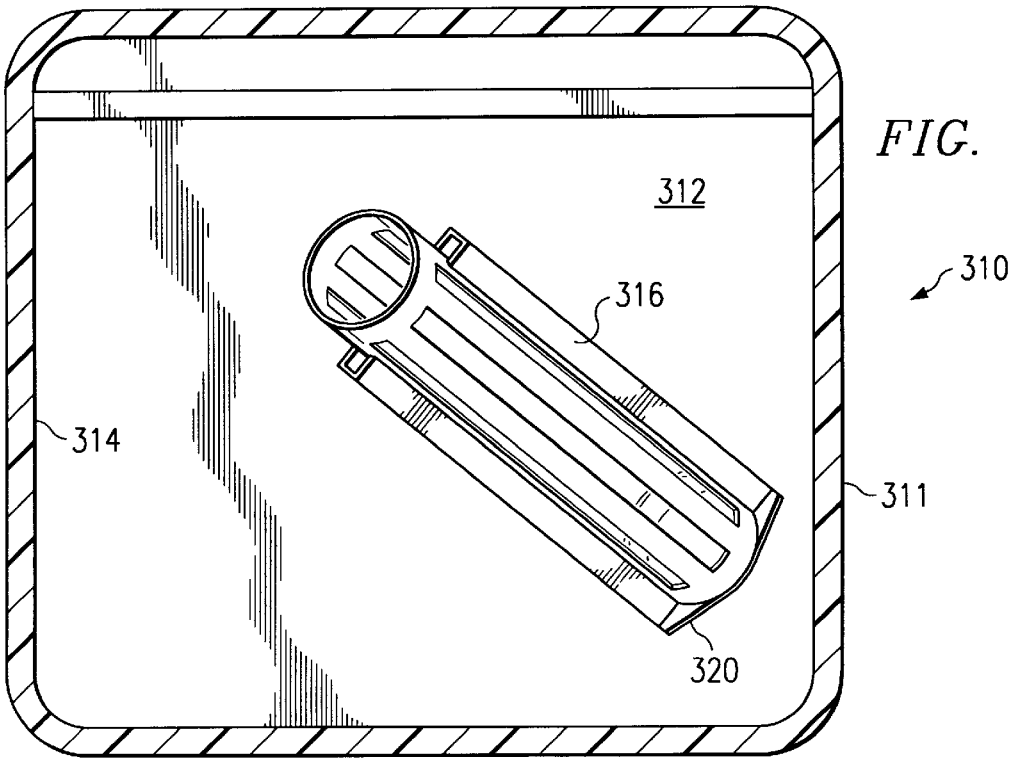
FIG. 11 is a cross sectional view of the wine case holder having selectively removable brackets.

Referring now to FIG. 10 and FIG. 11 there is illustrated yet another embodiment of the invention at 310 comprising an ice chest 311 defining a first receptacle 312 defined by side walls 314, selectively attached to one side wall 314 is a downwardly extending second receptacle 316 for receiving a beverage container. The receptacle 316 mates with a counterpart bracket 320 in a cooperating relationship to be secured to wall 314, allowing the second receptacle 316 to be selectively attached to and selectively removed from the wall of the first container.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A unitary cooling apparatus, comprising:

a body member having a plurality of walls including a first wall defining a first receptacle for receiving ice, said body member further comprising an integral elongated second receptacle having a sidewall extending inwardly into said first receptacle and adapted to receive a separate device, said first receptacle sidewall being perforated.

2. The apparatus as specified in claim 1 wherein said second receptacle is selectively coupled to and detachable from said first wall.

3. The apparatus as specified in claim 1 wherein said body member has a bottom portion also defining said first receptacle, wherein said second receptacle angles downwardly from said first wall toward said bottom portion into said first receptacle.

4. The apparatus as specified in claim 3 wherein said body member is generally cylindrical.

5. The apparatus as specified in claim 3 wherein said second receptacle has an end portion disposed opposite said first wall, said end portion also being perforated.

6. The apparatus as specified in claim 1 wherein said substantially all of said second receptacle wall is perforated.

7. The apparatus as specified in claim 1 further comprising ice disposed in said first receptacle.

8. In combination:

a body member having a plurality of walls including a first wall defining a first receptacle adapted to receive ice, said body member further comprising an elongated second receptacle having a sidewall extending inwardly into said first receptacle and adapted to receive a separate device, said first receptacle sidewall being perforated; and ice means for producing and dispensing ice into said first receptacle proximate said second receptacle.

9. The combination as specified in claim 8 wherein said ice means is adapted to dispense said ice substantially about said second receptacle.

10. The combination as specified in claim 8 wherein said body member has a bottom portion also defining said first receptacle, wherein said second receptacle angles downwardly from said first wall toward said bottom portion into said first receptacle.

11. The apparatus as specified in claim 10 wherein said body member is generally cylindrical.

12. The apparatus as specified in claim 10 wherein said second receptacle has an end portion disposed opposite said first wall, said end portion also being perforated.

13. The apparatus as specified in claim 8 wherein said second receptacle is selectively coupled to and detachable from said first wall.

14. The apparatus as specified in claim 8 wherein said substantially all of said second receptacle wall is perforated.

15. The apparatus as specified in claim 8 wherein said first receptacle contains ice.

16. An container cooling apparatus, comprising:

a first chamber;

a body member disposed in said first chamber, said body member having a plurality of walls including a first wall defining a first receptacle adapted to receive ice, said body member further comprising an integral elongated second receptacle having a sidewall extending inwardly into said first receptacle and adapted to receive a separate device, said first receptacle sidewall being perforated; and ice means for producing and dispensing ice into said first receptacle proximate said second receptacle.

17. The combination as specified in claim 16 wherein said first chamber is sealed and has a door for selectively accessing said second receptacle.

18. The combination as specified in claim 16 wherein said chamber has a shelf and said body member is disposed upon said shelf.

19. The combination as specified in claim 16 wherein said body member is integrally formed in said chamber.

20. The combination as specified in claim 16 further comprising a freezing unit generating air into said chamber, said air having a temperature at or below 32 degrees Fahrenheit.

* * * * *